US005617828A

United States Patent [19]

Kuegel et al.

[11] Patent Number: 5,617,828

[45] Date of Patent: Apr. 8, 1997

[54] FUEL INJECTION VALVE FOR INTERNAL COMBUSITON ENGINES

[75] Inventors: Peter Kuegel; Tolunay Demir; Thomas Kugler, all of Bursa, Turkey

[73] Assignee: Robert Bosch GmbH, Stuttgart, Germany

[21] Appl. No.: 675,662

[22] Filed: Jul. 3, 1996

[30] Foreign Application Priority Data

Jul. 5, 1995 [DE] Germany ..... 195 24 520.2

[51] Int. Cl.[6] ..... F02M 55/02

[52] U.S. Cl. ..... 123/468; 123/470; 285/382.5

[58] Field of Search ..... 123/468, 469, 123/470, 472, 193.3; 285/382, 382.4, 382.5

[56] References Cited

U.S. PATENT DOCUMENTS

| | | | |
|---|---|---|---|
| 3,845,748 | 11/1974 | Eisenberg | 123/468 |
| 4,485,790 | 12/1984 | Nishimura et al. | 123/468 |
| 4,705,306 | 11/1987 | Guido et al. | 123/469 |
| 4,715,103 | 12/1987 | Jaksa et al. | 285/382.4 |
| 4,881,763 | 11/1989 | Guido et al. | 123/469 |
| 5,365,907 | 11/1994 | Dietrich et al. | 123/468 |

FOREIGN PATENT DOCUMENTS 0569727 12/1995 European Pat. Off. .

*Primary Examiner*—Thomas N. Moulis
*Attorney, Agent, or Firm*—Edwin E. Greigg; Ronald E. Greigg

[57] ABSTRACT

A fuel injection valve for internal combustion engines, with a high pressure connection, which feeds laterally into a valve retaining body inserted into the engine housing, which connection is constituted by a pressure pipe connector which is inserted into a through bore in the housing. The pressure pipe connector is connected to a pressure line by means of a male pipe fitting and is axially braced by this fitting against a seat on the circumference face of the valve retaining body. In order to limit the clamping forces of the high pressure connection introduced radially onto the valve retaining body, a region is provided between the force introduction onto the pressure pipe connector and its contact with the valve retaining body, which region plastically deforms from a particular clamping force onward.

9 Claims, 7 Drawing Sheets

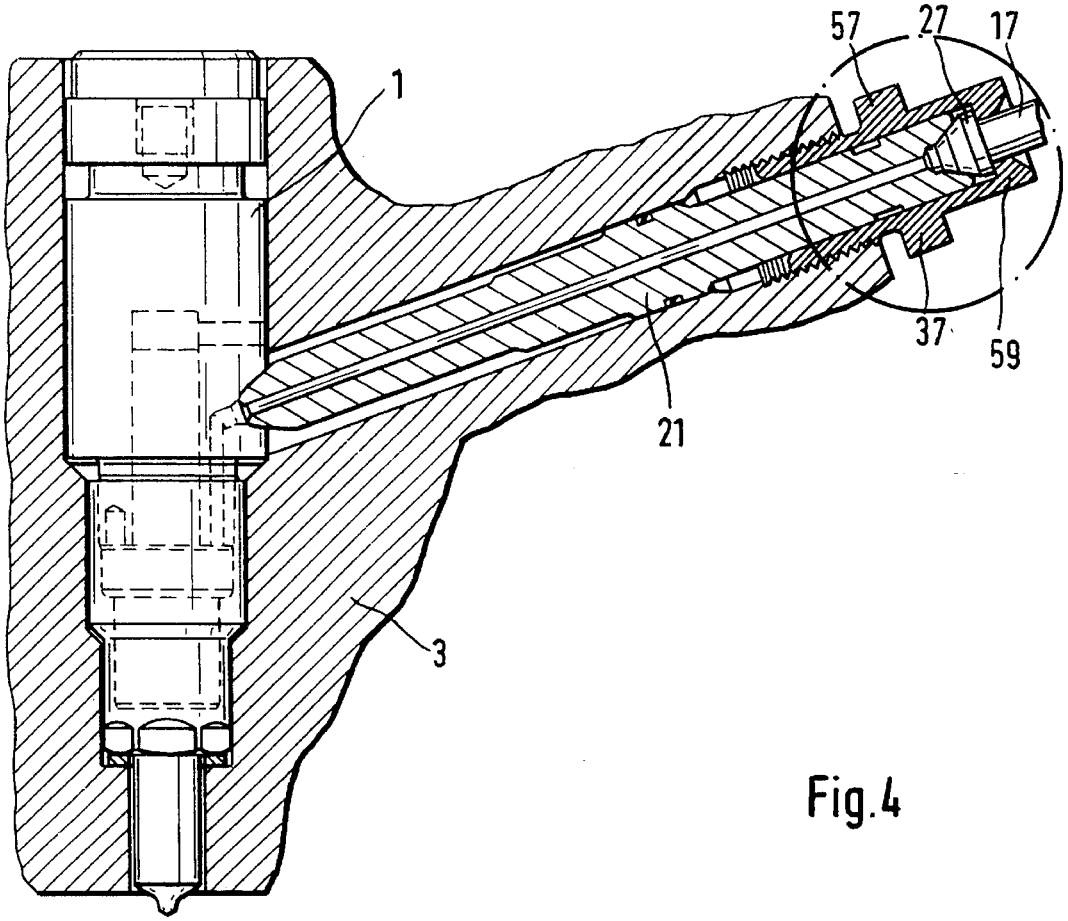
Fig.4
Fig.4A
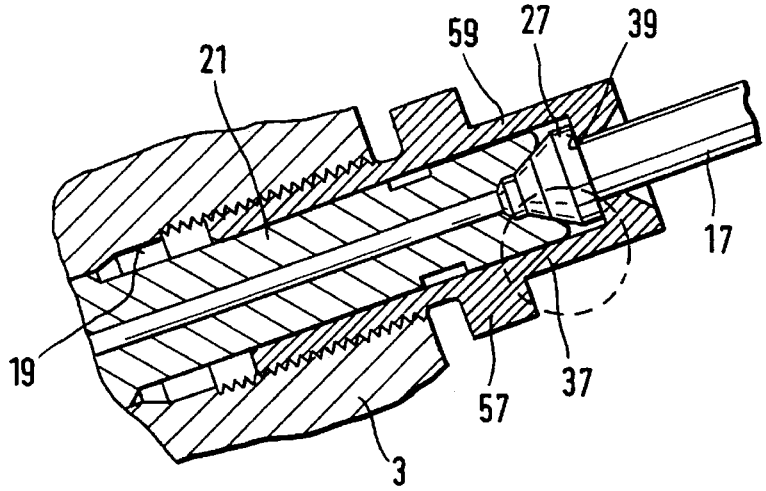

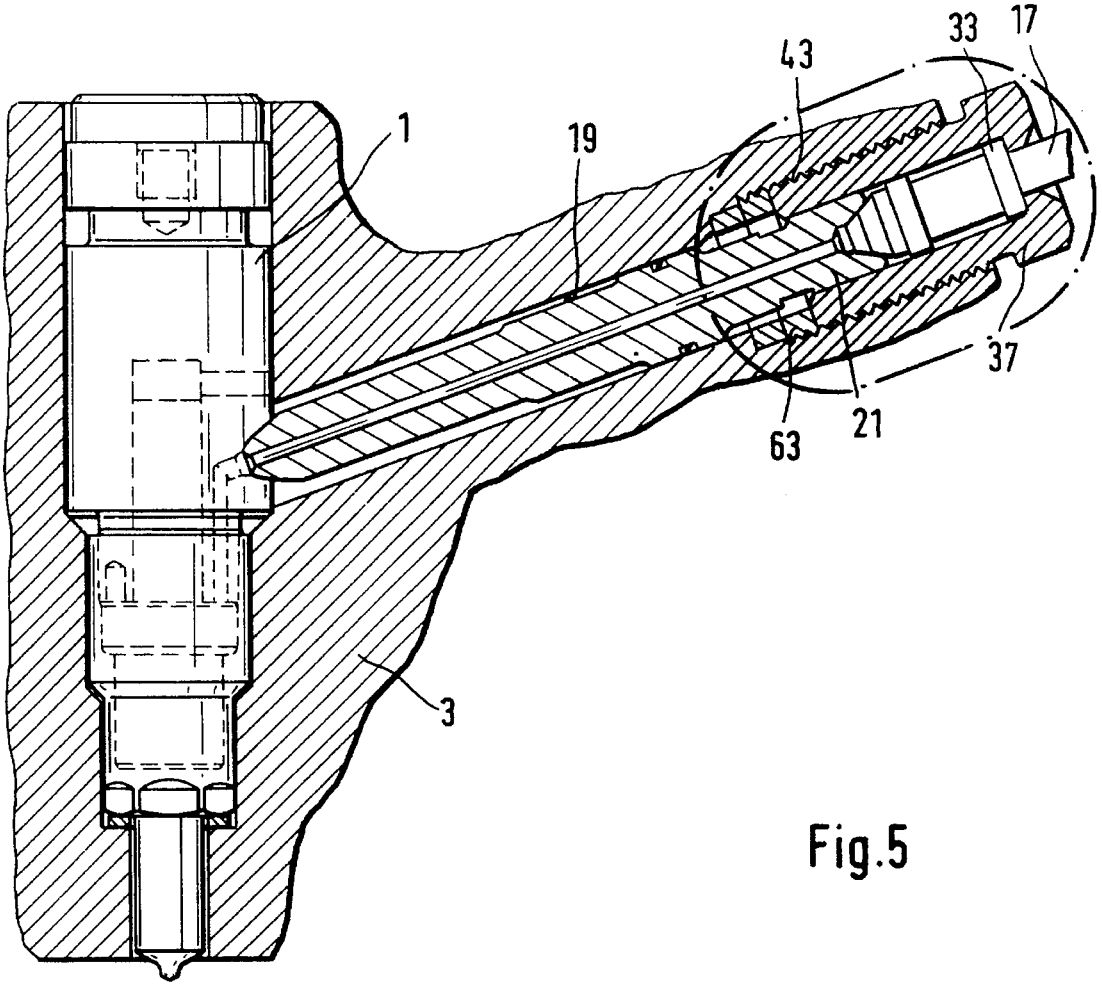
Fig.5
Fig.5A
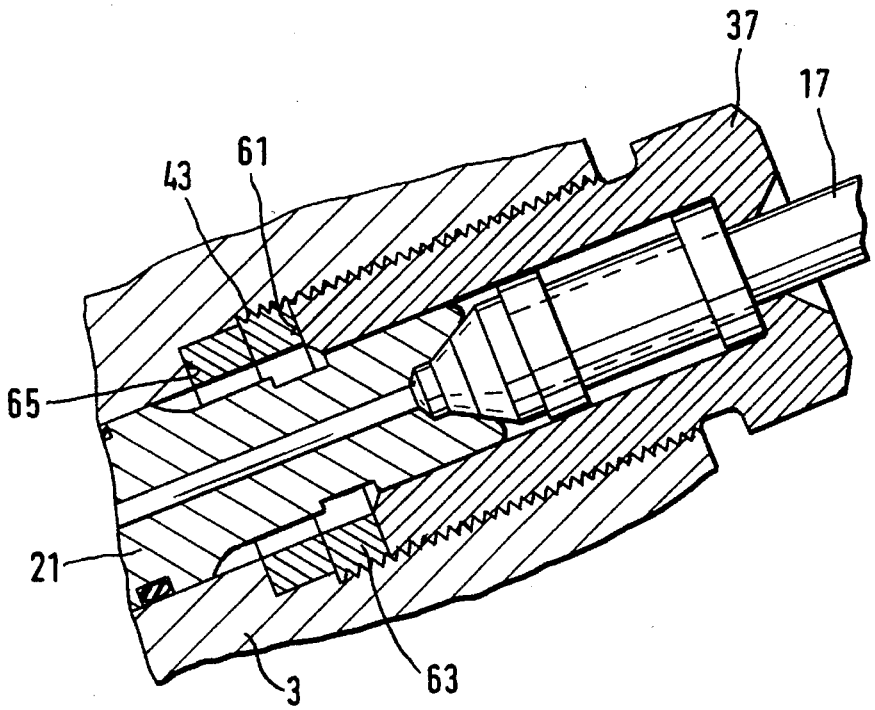

FUEL INJECTION VALVE FOR INTERNAL COMBUSITON ENGINES

BACKGROUND OF THE INVENTION

The invention is based upon a fuel injection valve for internal combustion engines. German Utility Model DE-Gbm. 92 06 268.7 discloses a fuel injection valve of this kind in which a valve body of the injection valve is attached by means of an adjusting nut to a valve body which is inserted into the housing of the internal combustion engine to be supplied. On its free end, the valve body has at least one injection opening, which projects into the combustion chamber of the engine and which adjoins a supply conduit, which extends in the valve body and in the valve retaining body, and can communicate with it by means of a movable valve member. On the intake side, the supply conduit is connected to a high pressure connection on the other end of which a pressure line is attached, which leads from a high pressure fuel pump. This high pressure connection is embodied as a pressure pipe connector inserted into a through bore of the engine housing. The one end of the pressure line is clamped against the end of the pressure pipe connector, which protrudes from the housing, by means of a male pipe fitting which encloses a fitting on the pressure line and which is screwed into the through bore in the housing and in this manner, presses the pressure pipe connector axially against the seat, which is provided on the valve retaining body and defines the supply conduit.

Because of installation conditions of the injection system in the engine, the seat face of the supply conduit on the valve retaining body which constitutes the connection of the supply conduit to the high pressure connection is disposed on the lateral circumference wall of the valve retaining body so that the axial bracing forces of the high pressure connection, which increase proportionally to the torque on the male pipe fitting, are introduced radially onto the cylindrical valve retaining body.

The high pressure connection on the known fuel injection valve, though, has the disadvantage that fluctuations in the axial sealing force of the lateral high pressure connection, which force depends upon the torque on the male pipe fitting, lead to sharp fluctuations in the permissible compression pulsating fatigue strength and therefore to losses in the durability of the retaining body.

OBJECT AND SUMMARY OF THE INVENTION

The fuel injection valve for internal combustion engines according to the invention has the advantage over the prior art that the bracing forces introduced radially onto the valve retaining body for sealing the pressure pipe connector can be limited to a particular limit value so that fluctuations of the permissible compression pulsating fatigue strength are prevented on the valve retaining body. This is achieved in an advantageous manner by means of the fact that between the area of the axial force introduction on the pressure line and the contact of the pressure pipe connector on the valve retaining body, at least one region is provided which plastically deforms from a particular axial compression force onward so that the bracing forces of the pressure pipe connector introduced radially onto the valve retaining body then no longer increase proportionally to the torque on the male pipe fitting, but instead increase only with a very flat rise.

This deforming region can be provided at the pressure line, the pressure pipe connector, an intermediary element, or the male pipe fitting, and is preferably constituted by a cross sectional reduction. It is particularly advantageous to provide the deforming regions in easily accessible and exchangeable components since in this manner, the permissible maximal clamping forces can be adapted to the respective conditions simply by means of exchanging the corresponding components.

The invention will be better understood and further objects and advantages thereof will become more apparent from the ensuing detailed description of preferred embodiments taken in conjunction with the drawings.

BRIEF DESCRIPTION OF THE DRAWINGS

FIGS. 1 to 5 each show an exemplary embodiment in a longitudinal section through the high pressure connection of the fuel injection valve;

FIG. 1 shows a first exemplary embodiment in which the deforming region is provided at the pressure line, FIG. 2 shows a second exemplary embodiment in which the deforming region is provided at an intermediary sleeve, FIG. 3 shows a third exemplary embodiment in which the deforming region is provided at the pressure pipe connector, FIG. 4 shows a fourth exemplary embodiment in which the deforming region is provided at the male pipe fitting, and FIG. 5 shows a fifth exemplary embodiment in which the deforming region is provided at a stop disk of the male pipe fitting.

FIGS. 1A to 5A, 2B and 3B additionally show details from FIGS. 1 to 5, in which the respective deforming regions are shown enlarged.

DESCRIPTION OF THE PREFERRED EMBODIMENTS

Figure 1:
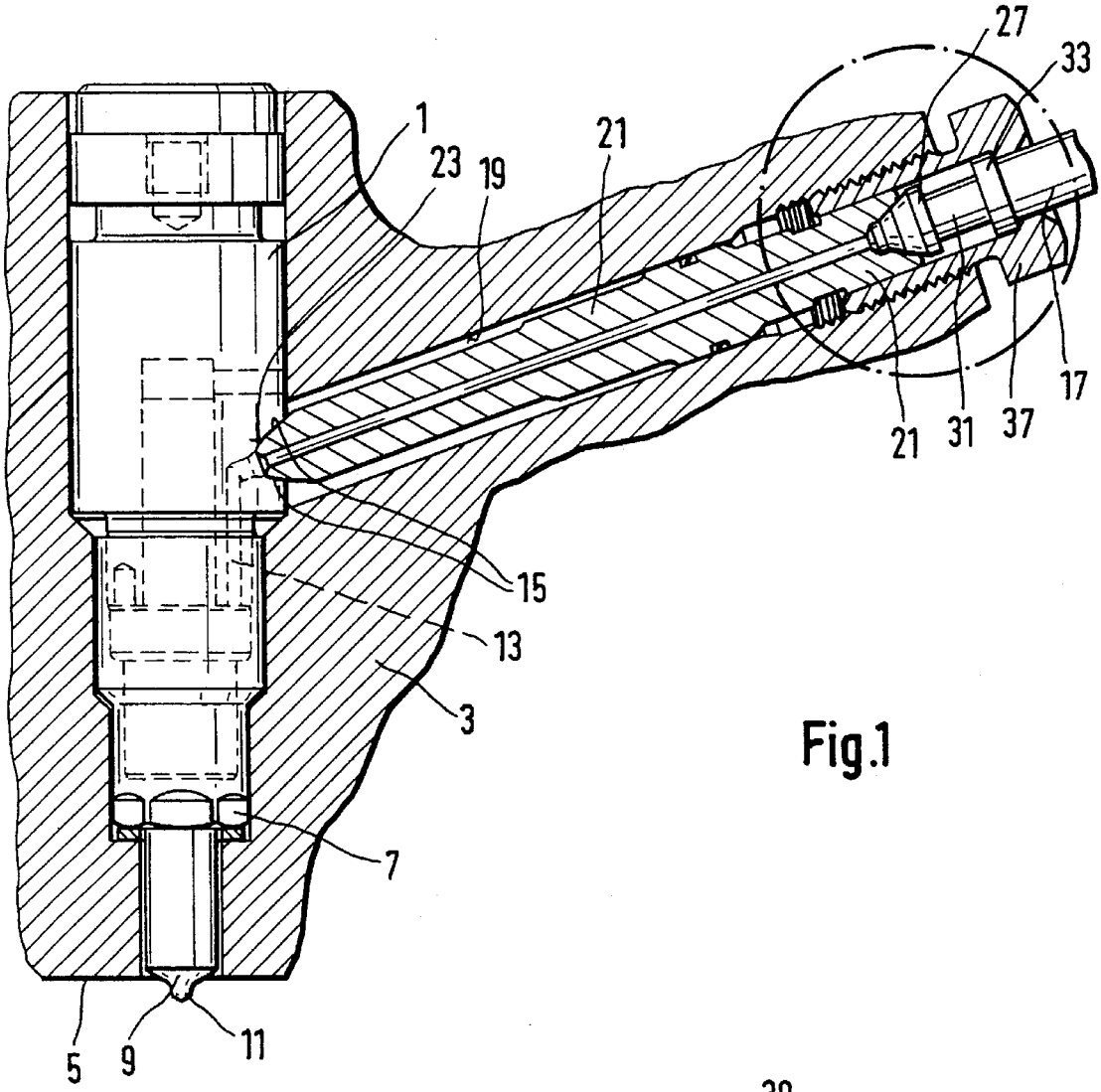

In the first exemplary embodiment of the fuel injection valve according to the invention, shown in FIG. 1, a cylindrical valve retaining body 1 is inserted into a corresponding receiving bore of a housing 3 of the internal combustion engine to be supplied. At the one end face of the valve retaining body 1, a valve body 5 of the injection valve is axially braced in a known manner by means of an adjusting nut 7, which encloses a step on the valve body, for which purpose the adjusting nut is screwed onto a part of the valve retaining body 1. With its end 9, which is remote from the valve retaining body 1 and has at least one injection opening 11, the valve body 5 protrudes from the housing 3 into a combustion chamber of the engine, not shown.

For supplying the fuel, which is under high injection pressure, to the injection opening 11, a supply conduit 13 is disposed in the valve retaining body 1, which conduit extends through the valve body 5 to the injection opening 11 and whose communication with the injection opening 11 can be opened and closed in a known manner by means of a movable valve member, which is not shown in detail. On the intake end, the supply conduit 13 in the valve retaining body 1 leads to a conical seat face 15, which is provided on the lateral circumference wall of the valve retaining body 1. This conical seat face 5 on the lateral circumference wall of the valve retaining body 1 is connected by means of a high pressure connection to a pressure line 17, which leads away from a high pressure fuel pump, which is not shown in detail.

The high pressure connection is constituted by means of a pressure pipe connector 21, which is inserted into a through bore 19 in the housing 3, which bore extends radially to the valve retaining body 1 and feeds into its receiving bore. On its end oriented toward the valve retaining body 1, the pressure pipe connector 21 has a conical sealing face 23, with which it rests sealingly against the seat face 15 of the supply conduit 13.

Figure 1A:
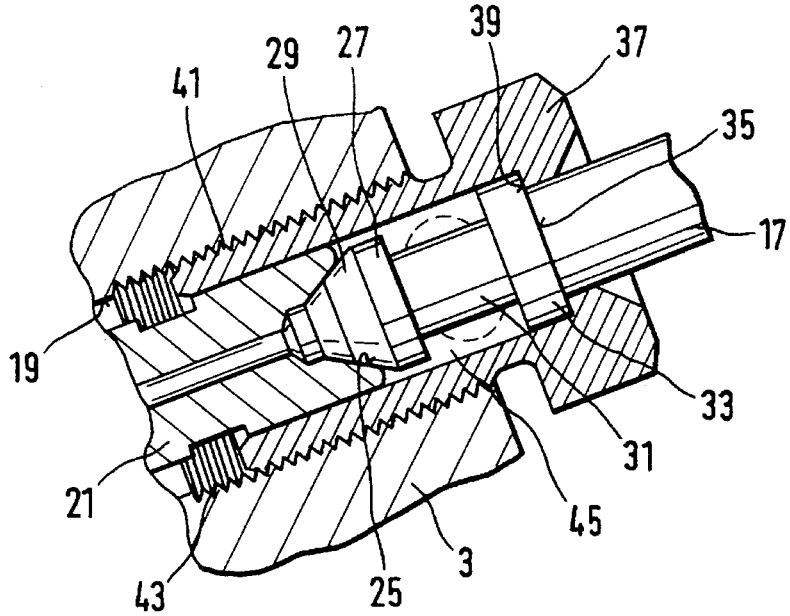

On its intake end, which is shown enlarged in FIG. 1A and is close to the outlet opening of the through bore 19, the pressure pipe connector 21 has a conical seat 25, which a head piece 27 disposed on the end of the pressure line 17 comes into contact with by means of a conical sealing face 29. On the end remote from the conical sealing face 29, the head piece 27 adjoins a tubular section 31, which is reduced in diameter in relation to the other cross section of the pressure line 17, which tubular section is adjoined on the other end by a rib 33. ON an annular face 35, which is formed on the rib 33 on its side remote from the tubular section 31, a male pipe fitting 37 comes into contact by means of an annular shoulder 39, which protrudes radially inward, and via a screw thread 41 disposed on its shaft, this male pipe fitting is screwed into a corresponding female thread 43 on the exit end of the through bore 19. The pressure pipe connector 21 is braced against the valve retaining body 1 by means of the screwing in of the male pipe fitting 37 via the pressure line 17 in an axially sealing manner against the conical sealing face 15 of the supply conduit 13; the forces introduced radially onto the valve retaining body 1 for the time being increase proportionally to the torque on the male pipe fitting 37.

In order to limit the axial bracing forces on the pressure pipe connector 21 to a particular quantity, the fuel injection valve according to the invention has a locally defined deforming region, which plastically deforms from a particular bracing force onward and thus prevents a further sharp increase of the bracing force introduced onto the valve retaining body 1.

In the first exemplary embodiment, this deforming region is constituted by the cross sectionally reduced tubular section 31 of the pressure line 17 between the head piece 27 and the rib 33; an annular gap 45 is provided between the jacket face of the tubular section 31 and the inner wall face of the male pipe fitting 37.

Figure 2:
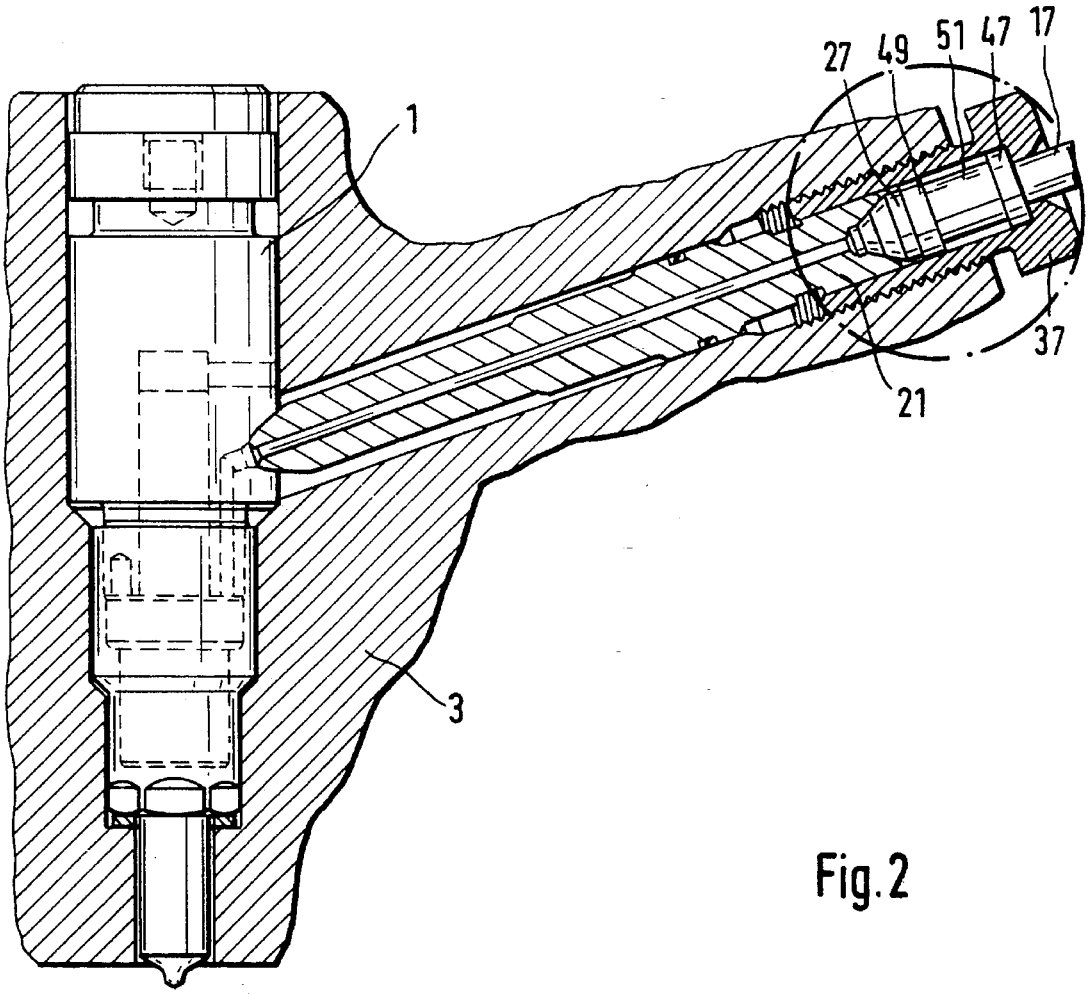
Figure 2A:
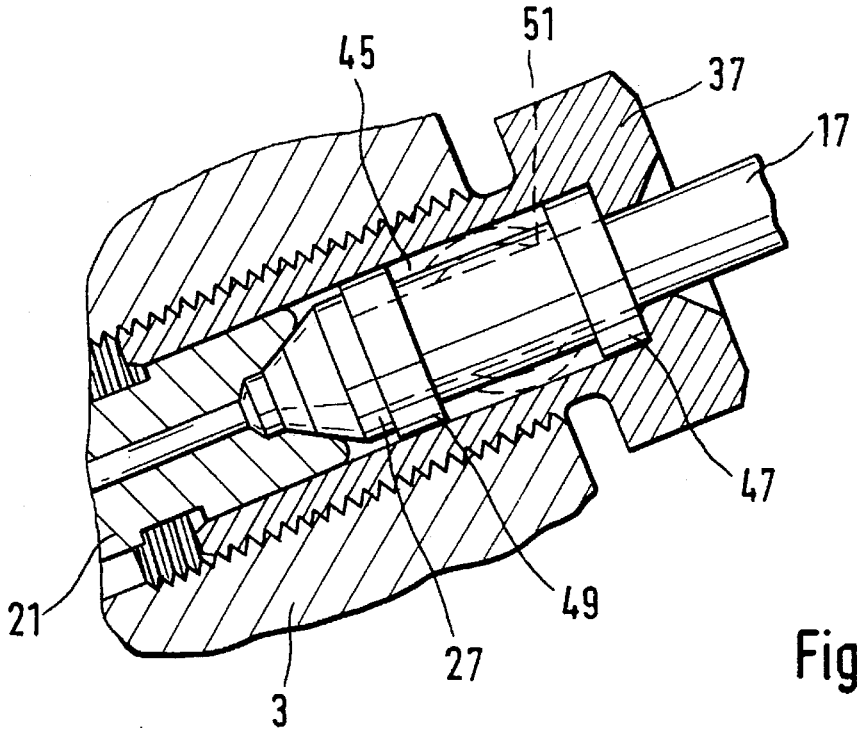
Figure 2B:
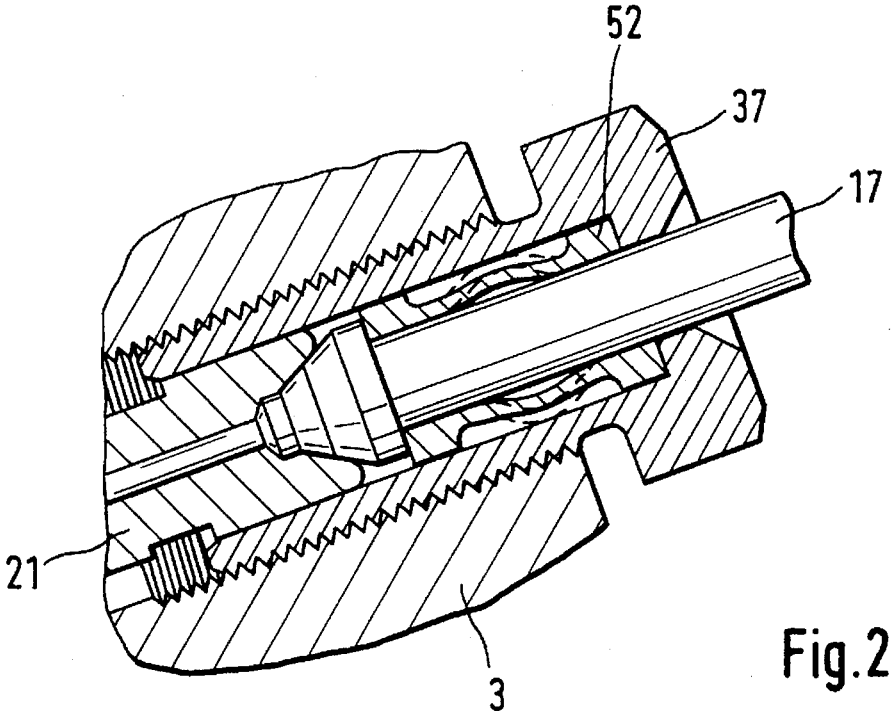

The second exemplary embodiment shown in FIGS. 2, 2A, and 2B differs from the first exemplary embodiment merely by means of the embodiment of the deforming region. The rib 33 from the first exemplary embodiment is now embodied as a first ring 47, which can be axially moved on the pressure line 17; a sleeve 51 is clamped between this ring and a second ring 49, which rests against the head piece 47. This sleeve, which constitutes an intermediary element made of a material which can be plastically deformed relatively easily, at first rigidly transmits the axial bracing force, which—analogously to the first exemplary embodiment—is transmitted by the male pipe fitting 37 onto the pressure line 17 and further onto the pressure pipe connector 21, and plastically deforms from a particular limit value onward; here, too, the annular gap 45 remaining between the sleeve 51 and the inner wall of the male pipe fitting makes the deforming motion possible and limits it to a particular quantity.

In the embodiment shown in FIG. 2B, the ring 47, the sleeve 51, and the ring 49 are embodied in one piece and thus constitute a deforming sleeve 52, which has an action which supports the desired deforming function by means of a suitable shape or a defined prior deforming.

Figure 3:
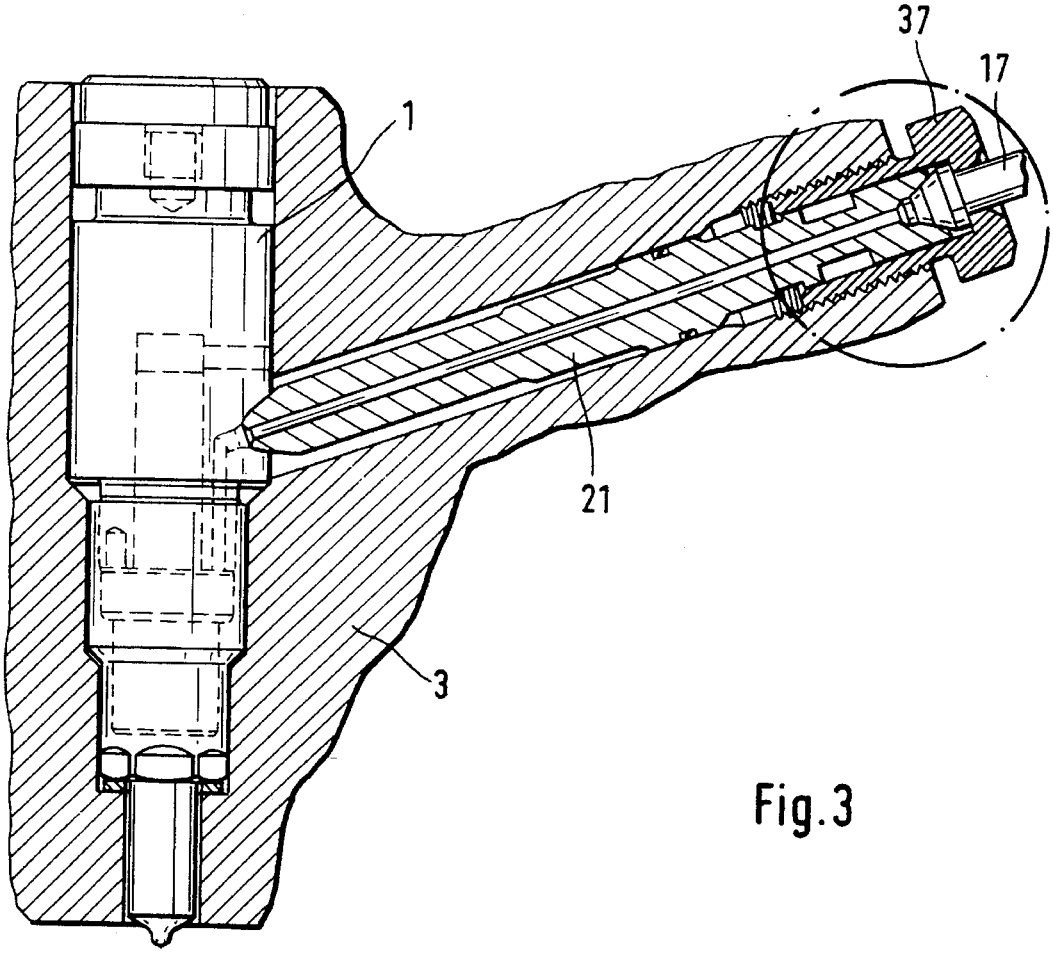
Figure 3A:
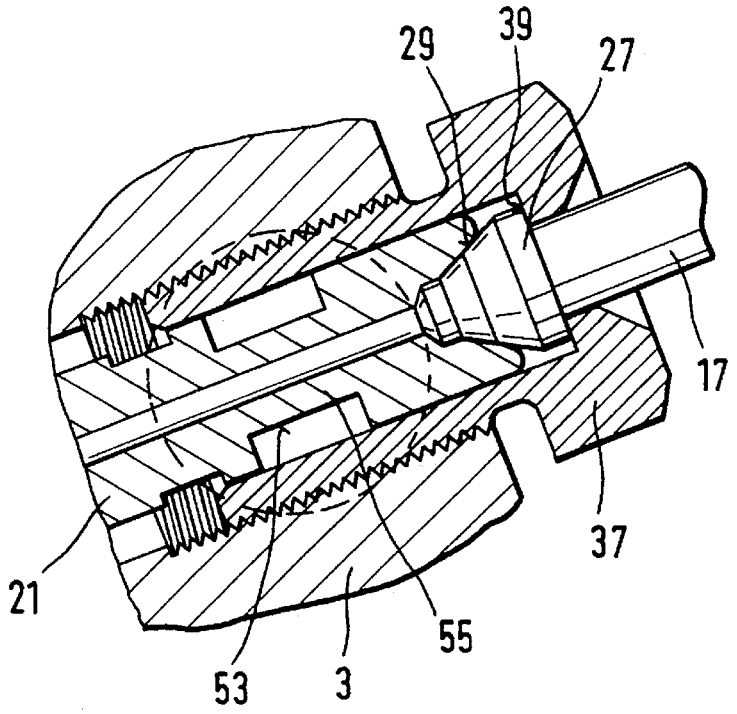
Figure 3B:
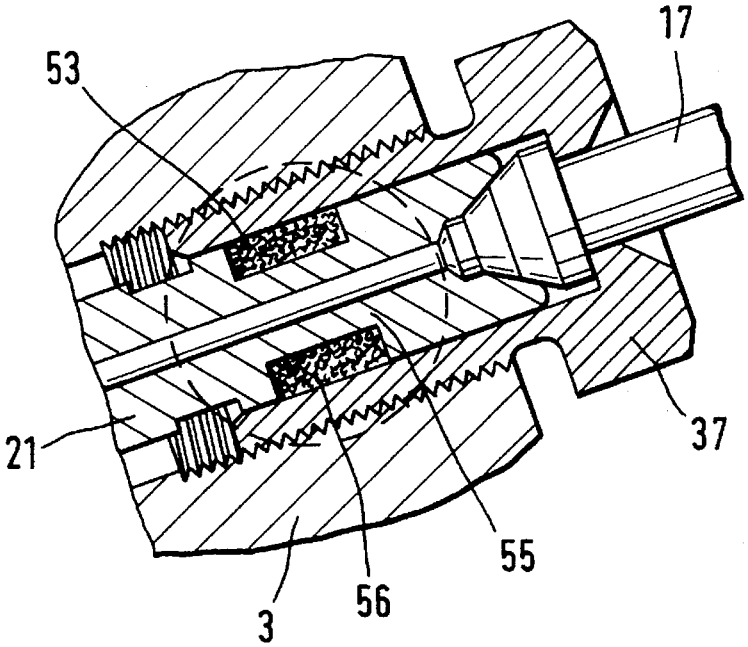

In the third exemplary embodiment shown in FIGS. 3, 3A, and 3B, the deforming region is provided at the pressure pipe connector 21, for which purpose the pressure pipe connector 21 has an annular recess 53 on its jacket face, by means of which a region 55 with a reduced cross section is formed. Analogous to the preceding exemplary embodiments, this region plastically deforms from a particular axial clamping force on the pressure pipe connector 21 onward so that an impermissible increase of the forces introduced onto the valve retaining body 1 is prevented. The male pipe fitting 37 directly engages the head 27 of the pressure line 17 with its annular shoulder 39.

The required crushing strength at the pressure pipe connector 21 can be assured by a defined deforming expansion, by corresponding materials, or—as shown in FIG. 3B—by additional damping elements 56 in the recess 53.

In the fourth exemplary embodiment shown in FIGS. 4 and 4A, the deforming region is provided at the male pipe fitting 37. To that end, the male pipe fitting 37, in the connection to the head 57, has an axial extension 59 in the direction remote from the pressure pipe fitting 21; the annular shoulder 39 which engages the head 27 of the pressure line 17 is disposed on the end of this extension. When the male pipe fitting 37 is screwed into the bore 19, the axial extension 59 now functions like an expansion bolt, which plastically deforms from a particular axial, tensile stress onward and thus prevents an impermissibly high increase of the clamping forces on the pressure pipe connector 21 and prevents their introduction onto the valve retaining body 1. The deforming geometry can also be embodied so that in addition to an axial expansion, a radial deforming is also possible, for example at a membrane.

In the fifth exemplary embodiment shown in FIGS. 5 and 5A, the deforming region is provided at an adjusting disk 63 clamped between the male pipe fitting 37 and the housing 3. The adjusting disk 63 is supported on an annular step 65 on the housing 3 of the engine, which step adjoins a bore for receiving the male pipe fitting 37, and on the other end, this disk is acted upon axially by an end face 61 of the male pipe fitting 37, which protrudes into the bore 19. The adjusting disk 63 is embodied in such a way that it plastically deforms from a particular axial compression force onward.

The use of a simply exchangeable adjusting disk 63 has the advantage that in addition to an initial adjustment, a new adjustment is also possible after disassembly and re-assembly of the screw connection, in which prior deforming and abrasion can be taken into account.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the U.S. is:

1. A fuel injection valve-for internal combustion engines, which comprises a valve retaining body (1) inserted into the housing (3) of the engine, said valve retaining body is axially connected to a valve body (5) of the injection valve by means of an adjusting nut (7), said valve retaining body protrudes into a combustion chamber of the engine, at least one fuel supply conduit (13) to an injection opening (11) is provided on the valve body (5) wherein a high pressure connection of the supply conduit (13) is constituted by a pressure pipe connector (21), said pressure pipe connector penetrates a through opening (19) in the housing (3) of the engine and is sealingly connected on an inlet end to a connecting piece of a pressure line (17) and which by means of a male pipe fitting (37) screwed into the through opening (19), this connector is pressed axially with a sealing face (23) on an outlet end, against a seat face (15) which adjoins the supply conduit (13) and is disposed on the lateral circumference wall of the valve retaining body (1), between the male pipe fitting (37), which at least indirectly clamps the pressure pipe connector (21), and its contact against the valve retaining body (1), a locally defined region is provided, which plastically deforms from a particular axial clamping force on the pressure pipe connector (21) onward.

2. The fuel injection valve according to claim 1, in which between a fuel introduction point (35) of the male pipe fitting (37) and the contact with the pressure pipe connector (21), the pressure line (17) has a cross sectionally narrowed region (31), which plastically deforms from a particular axial clamping force on the pressure pipe connector (21) onward.

3. The fuel injection valve according to claim 1, in which at least one axial intermediary element is provided between the individual components of the high pressure connection, which plastically deforms from a particular axial clamping force of the pressure pipe connector (21) onward.

4. The fuel injection valve according to claim 3, in which the at least one intermediary element is constituted by a sleeve (51), which is embodied between a ring (47), which can move axially on the pressure line (17) and functions as a force introduction point of the male pipe fitting (37), and a head piece (27, 49) of the pressure line (17), which head rests against the pressure pipe connector (21).

5. The fuel injection valve according to claim 4, in which the ring (47) and the sleeve (51) are embodied in one piece.

6. The fuel injection valve according to claim 1, in which the pressure pipe connector (21) has a cross sectional reduction constituted by an annular recess (53), in whose region, the pressure pipe connector (21) plastically deforms from a particular axial clamping force onward.

7. The fuel injection valve according to claim 6, in which a crushable damping element (56) is inserted into the annular recess (53).

8. The fuel injection valve according to claim 1, in which the male pipe fitting (37) is embodied as an expansion bolt which, in the region of the axial introduction of force onto the pressure pipe connector (21), has a reduced cross section with a correspondingly embodied deforming geometry in such a way that the reduced cross section plastically deforms from a particular clamping force onward.

9. The fuel injection valve according to claim 1, in which an adjusting disk (63) is clamped between the male pipe fitting (37) and an annular step (65) fixed to the housing, which disk plastically deforms from a particular clamping force onward.

* * * * *